United States Patent [19]

Grave

[11] Patent Number: 4,649,594

[45] Date of Patent: Mar. 17, 1987

[54] CLEANING HEAD FOR SMOOTH AND NAPPED SURFACE COVERING MATERIALS

[76] Inventor: Dale L. Grave, 125 Queensland La. North, Plymouth, Minn. 55447

[21] Appl. No.: 789,117

[22] Filed: Oct. 18, 1985

[51] Int. Cl.[4] ..... A47L 7/00

[52] U.S. Cl. ..... 15/322; 15/321

[58] Field of Search ..... 15/322, 321

[56] References Cited

U.S. PATENT DOCUMENTS

| | | | |
|---|---|---|---|
| 742,880 | 11/1903 | Lotz . | |
| 2,574,731 | 11/1951 | Dapprich | 15/346 X |
| 3,186,132 | 9/1963 | Duncan | 51/11 |
| 3,619,849 | 11/1971 | Jones | 15/321 |
| 3,654,662 | 4/1972 | Bates | 15/302 |
| 3,663,984 | 5/1972 | Anthony | 15/321 |
| 3,747,155 | 7/1973 | Koellisch | 15/322 |
| 3,775,053 | 11/1973 | Wisdom | 8/142 |
| 3,840,935 | 10/1974 | Fitzgerald, Jr. | 15/322 |
| 3,919,729 | 11/1975 | Cannan | 8/158 |
| 3,964,925 | 6/1976 | Burgoon | 134/21 |
| 4,194,262 | 3/1980 | Finley | 15/314 |
| 4,335,486 | 6/1982 | Kochte | 15/322 X |
| 4,488,330 | 12/1984 | Grave | 15/322 |
| 4,596,061 | 6/1986 | Henning | 15/322 |

FOREIGN PATENT DOCUMENTS

| | | | |
|---|---|---|---|
| 972510 | 8/1975 | Canada | 15/346 |

*Primary Examiner*—Chris K. Moore

*Attorney, Agent, or Firm*—Leo Gregory

[57] ABSTRACT

A cleaning head for a surface covering material cleaning machine made up as a nozzle embodying a pair of chambers separated by a transverse plate member, one chamber being a cleaning chamber having a jet stream of cleaning fluid with an incoming air stream comingling therewith to form an aerated stream, the chambers flaring forwardly being coextensive at their forward ends and the cleaning chamber decreasing in height forwardly, the chamber communicating at the free end of the plate member, the end portion of the plate member having a terminal portion the width of said chambers whereby the other chamber forming a suction chamber draws upon the cleaning fluid causing it to accelerate substantially horizontally in engaging the surface portion and/or passing through the body portion of the material being cleaned and then being withdrawn upwardly about the end of the plate member to pass into and become discharged through the suction chamber.

12 Claims, 5 Drawing Figures

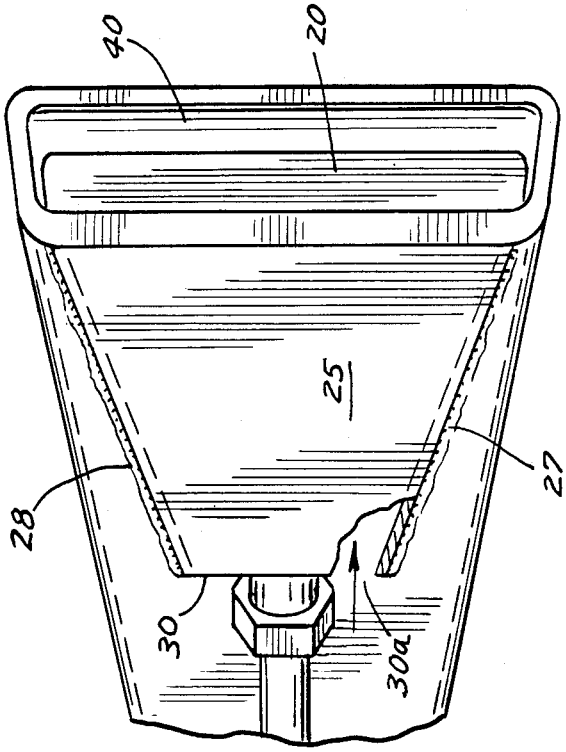
FIG. 4
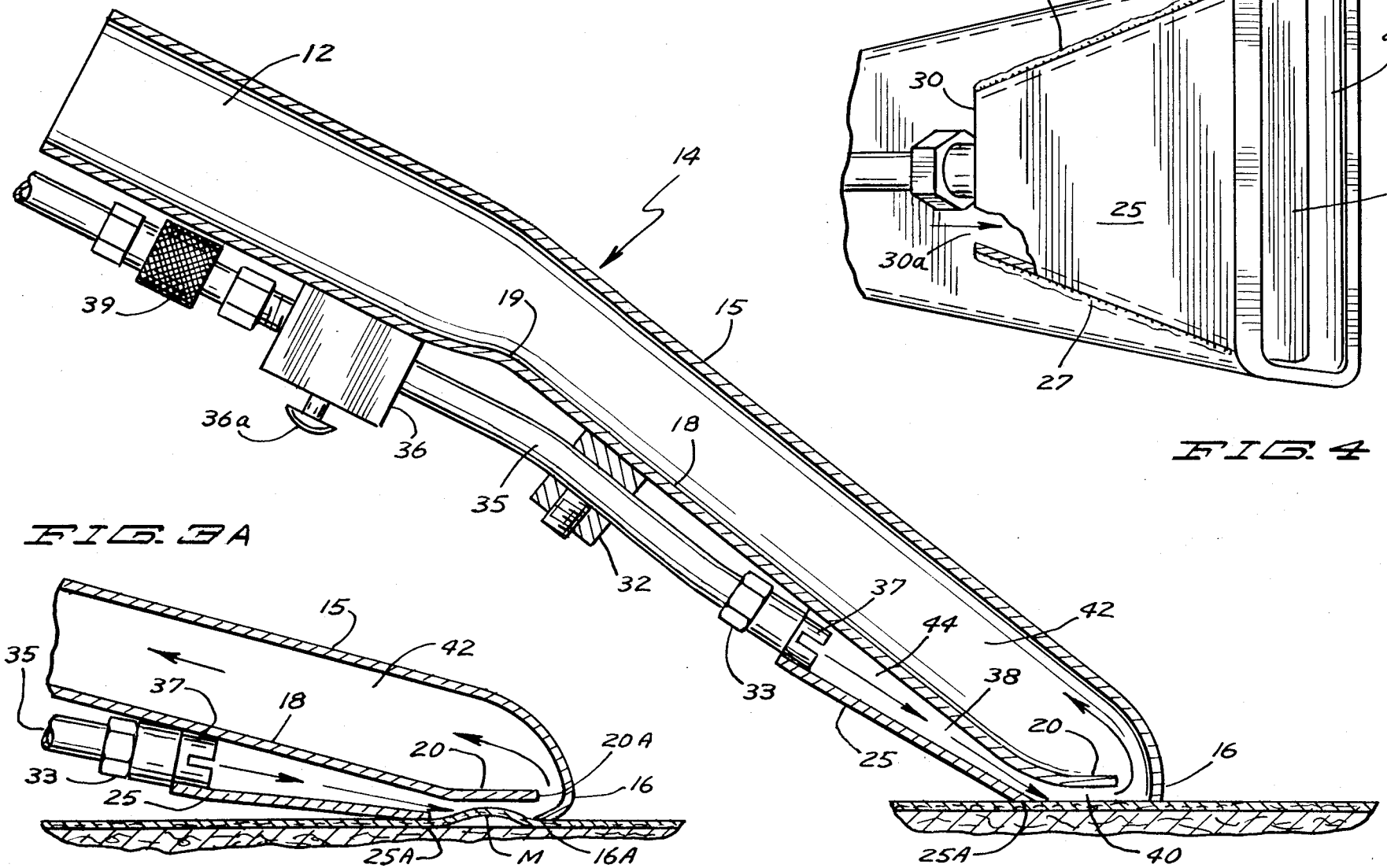
FIG. 3
FIG. 3A

CLEANING HEAD FOR SMOOTH AND NAPPED SURFACE COVERING MATERIALS

BACKGROUND OF THE INVENTION

1. Field of the Invention

This invention relates to a nozzle structure for a material cleaning machine through which there is a continuous action of applying an aerated jet stream of cleaning fluid to a material to be cleaned and a withdrawal of said stream from the cleaned material.

2. Description of Prior Art

In general, prior art devices apply a stream of cleaning fluid directly onto the base of the material to be cleaned with the force of the stream being used to loosen the soil. The result is a puddling and saturating effect and subsequently the fluid is withdrawn.

In Hayes U.S. Pat. No. 3,262,146 there is shown a two chamber nozzle structure which applies a high pressure cleaning fluid from one chamber and draws a vacuum through an adjacent chamber. Hayes employs a vapor which becomes a condensate upon engaging the surface to be cleaned. A puddling effect results prior to withdrawal of the condensate.

The applicant in his U.S. Pat. No. 4,488,330 provides significant improvement in introducing an air stream to mingle with the cleaning fluid to engage the nap or pile of material to be cleaned at a shallow angle with a coordinate vacuum drawing said fluid through the nap or pile of the material being cleaned and withdrawing the fluid leaving a minimal residue.

Other commonly used devices utilize cleaning pads and brushes of various kinds to work the cleaning fluid into the material to be cleaned.

SUMMARY OF THE INVENTION

This invention represents improvement over the structure disclosed by applicant in his said U.S. Pat. No. 4,488,330 in providing a split nozzle housing having an upper vacuum chamber and a lower cleaning chamber, the housing flaring forwardly with the cleaning chamber reducing in height, the rear of the cleaning chamber having communication with the atmosphere for an air stream to be drawn therethrough, the housing being divided by a transverse plate to form the chambers, said plate having a forward end portion which is angled to be substantially horizontal in operating position, the vacuum in drawing upon said chamber causes the cleaning fluid and air stream to comingle to stream forwardly evenly the full width of the cleaning chamber causing a forward pull on the cleaning fluid through the material being cleaned, the housing having a transverse slot underlying said flange through which the cleaning solution engages the material to be cleaned, and the vacuum causes a continuous motion of said cleaning fluid, drawing the same forwardly under said end portion of said plate and then upwardly around the end of said plate member to withdraw and discharge the same through the vacuum chamber.

It is a specific object of the invention herein to direct a stream of cleaning fluid comingling with an incoming air stream to engage a material to be cleaned at such an angle that said fluid in a continuous motion is drawn forwardly through the pile, nap, surface portion or body of the material to be cleaned, as the case may be, and by suction thereupon, said solution is lifted upwardly to be withdrawn from said material and discharged through the vacuum chamber.

These and other objects and advantages of the invention will be set forth in the following description made in connection with the accompanying drawings in which like reference characters refer to similar parts throughour the several views.

BRIEF DESCRIPTION OF THE DRAWINGS

FIG. 3 is a view in vertical section taken on line 3—3 of FIG. 1 as indicated, FIG. 3*a* is a broken view showing a modification of a detail of structure; and FIG. 4 is a broken view in elevation taken on line 4—4 of FIG. 2 as indicated.

DESCRIPTION OF A PREFERRED EMBODIMENT

Figure 1:
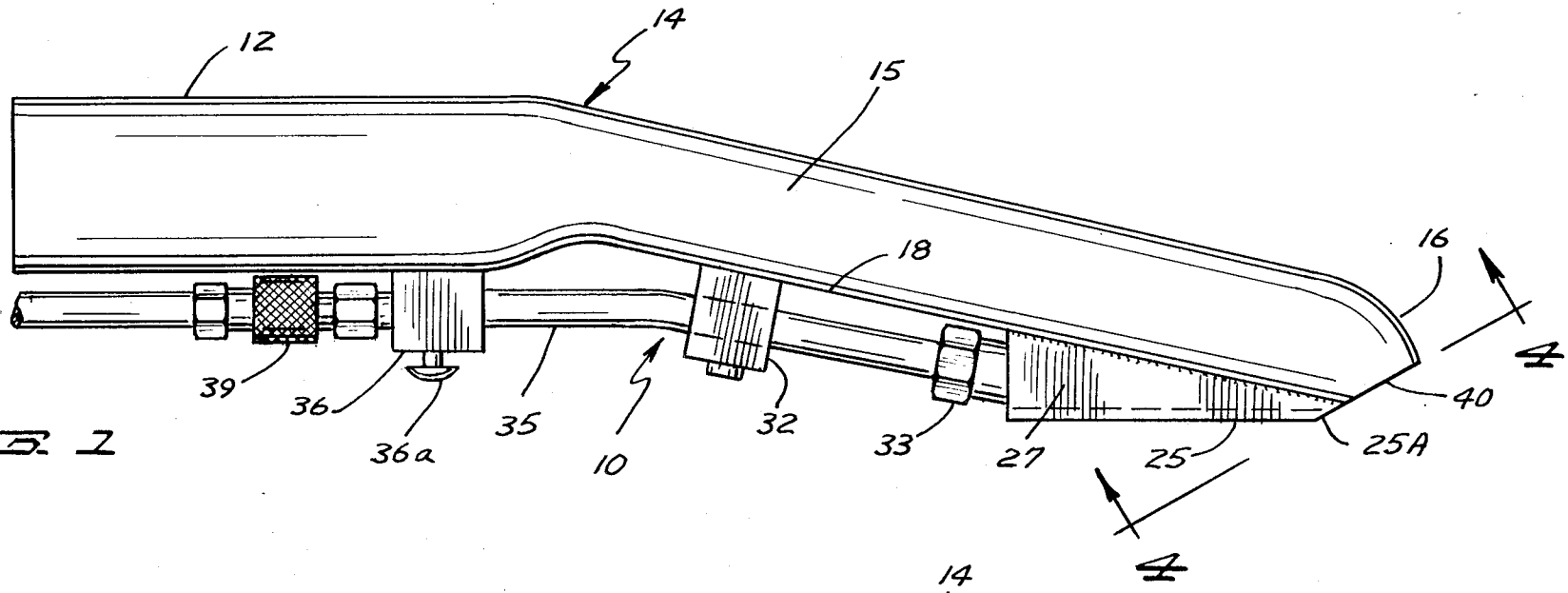
FIG. 1 is a bottom plan view.

Referring to the drawings, the nozzle structure comprising the subject matter of the invention herein is indicated generally by the reference numeral 10. The remainder of the cleaning apparatus with which the nozzle is intended for use is not shown, it is referred to incidentally and forms no part of the present invention.

Said nozzle is made up for the most part of suitable metal or plastic molded components.

Said nozzle structure of nozzle consists of a tubular housing portion 12 which extends as a flared portion 14, the upper wall 15 of which has a downwardly rounded terminal or nose portion 16. The lower wall 18 thereof is upwardly upset as at 19 and extends forwardly until just short of the upper wall end portion 16 at which point the terminal portion 20 of said lower wall is here shown in the present embodiment to be formed as a free flange portion angled to be substantially horizontal in its operating position as will be described, the same being subject to adjustment.

Underlying said wall 18 is a rearwardly tapered channel member 25 having side walls 27 and 28 as exemplified by wall 27 and having an opening 30*a* at its rear 30 to communicate with the atmosphere.

Secured to the lower wall 18 by a suitable clamp means 32 is a cleaning fluid supply line 35 which is suitably secured to the central rear end portion of the channel member 25 as at 33 and from the terminal 35*a* of said line is a fluid outlet or jet 37 from which will be emitted a stream of cleaning fluid 38 as will be described. Said line 35 will run to a source of cleaning fluid which will be carried by supporting apparatus not here shown.

Figure 2:
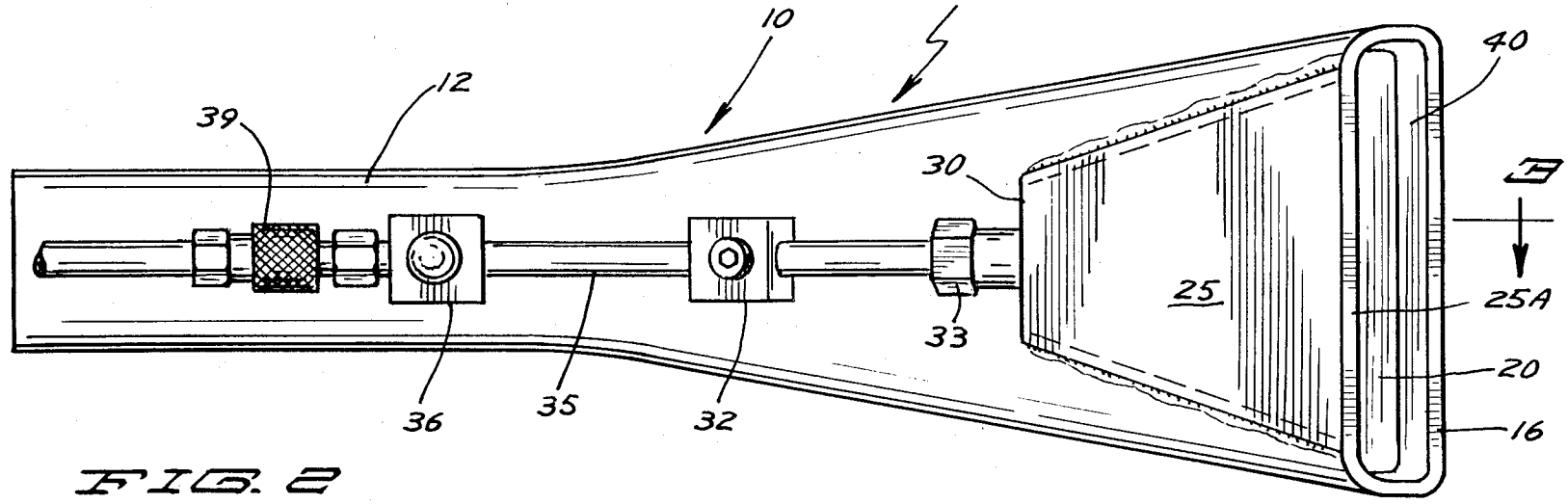
FIG. 2 is a view in side elevation.

A conventional flow control valve 36 is installed in said line 35 as shown in FIGS. 1 and 2, said valve having a flow modulating stem 36*a* which is manually operable. Adjacent to said valve is a conventional spring loaded quick disconnect pipe connector 39.

The forward free end 25*a* of said channel member 25 is spaced from the adjacent terminal portion 16 of said upper wall 15 forming therebetween an elongated substantially rectangular transverse slot 40 which, when the nozzle is in operating position, engages and is moved along the material to be cleaned.

It is noted that the terminal portion or flange 20 is substantially parallel to the plane of said slot 40. Said terminal portion 20 may be variously angled or adjusted as to its spacing from and angular relationship to the plane of said slot 40.

The upper chamber 42 of said nozzle is a vacuum or suction chamber and the lower chamber 44 is a cleaning chamber as shown. The chambers may be reversed as to their positions. The housing 14 of said upper chamber extends upwardly into said tubular housing 12 which in turn becomes a handle member of the operating apparatus, neither being shown.

OPERATION

In operating position, the nozzle 10 will be held as in FIG. 3 with the slot 40 flush upon the area of the material to be cleaned.

Vacuum is drawn upon the chamber 42 and it will cause the pile, nap, or body, as the case may be, of the material to be cleaned within the area said slot to be drawn upwardly. The cleaning fluid is provided under adequate pressure through the line 35 and into and through the cleaning chamber 44. The rear 30 of the cleaning chamber is adapted to communicate with the atmosphere through an appropriate opening 30*a*. Air passes freely into and through the cleaning chamber.

The movement of the air and cleaning fluid passing into and through the cleaning chamber is accelerated by the effect of the vacuum upon the area at the slot 40.

The stream of cleaning fluid from the jet 37 is preferably a pressurized stream and the stream upon leaving the jet 37 mixes with incoming air and commences to fan out to the full width of the chamber 44 whereby at the slot area the cleaning solution mixed with the entrained air has a uniform application to the area defined by said slot as said slot is moved forwardly and rearwardly in the cleaning operation.

The end portion 20 provides an important function in the cleaning process.

Said end portion 20 causes the vacuum of the chamber 42 to have the effect of drawing the cleaning fluid forwardly through the pile, nap, or the surface or other portion of the material being cleaned prior to lifting and withdrawing said fluid upwardly at the end of said flange and to discharge the same through the vacuum chamber. This action accelerates the movement of the cleaning fluid throughout the cleaning operation and avoids the tendency for cleaning solution to deposit into the base of the material. Thus the base does not become unduly saturated and the fluid is drawn out of the material so as to leave a minimal residue. There is no puddling or soaking effect as is present with prior art cleaning devices. In cleaning a hard surface, the surface is left in substantially a dry condition.

The end portion 20 is here shown manually adjustable as to its angle of tilt relative to the plane of the slot 40 to have nicely arranged the spacing between itself and the underlying material to be cleaned. There is a uniform dispersal of aerated cleaning fluid the full width of said slot 40. The cleaning fluid effectively penetrates and cleans the soil laden portion of the material in a continuous movement to provide a highly satisfactory cleaning effect.

The full width rear opening of the chamber 44 as here shown permits air to enter freely and pass through said chamber. The pull of the vacuum causes the stream from the jet 37 to fan out the full width of said chamber and the pressure of fluid with the incoming air becoming entrained therein increases in pressure as the height of said chamber lessens in the direction of said slot 40.

The structure has been extensively tested and has produced very satisfactory cleaning results.

A modification is shown in FIG. 3*a* with reference to the top portion 16 of the upper wall 15 of the suction chamber.

In the modification the tip 16 is shown as 16*a* and is curved reversely to be in vertical alignment with the tip 20*a* of said terminal portion 20 or to somewhat underlie said tip. This structure causes the vacuum drawn upon the slot 40 to cause a forward horizontal movement of the cleaning fluid more so than an upward movement. Thus the suction developed causes the cleaning fluid to more intensely perform its cleaning action. The material M being cleaned is shown being drawn upwardly some what in the cleaning operation. This is particularly the case in cleaning upholstery material.

It will of course be understood that various changes may be made in form, details, arrangement and proportions of the parts without departing from the scope of the invention herein, which generally stated, consists in an apparatus capable of carrying out the objects above set forth, in the parts and combinations of parts disclosed and defined in the appended claims.

What is claimed is:

1. In connection with a cleaning machine for smooth and napped surface materials, a nozzle structure comprising a housing member having an upper and a lower wall, said upper wall terminating in a tip portion, said lower wall terminating in an end portion spaced from said tip portion of said upper wall, a plate member underlying and being spaced below the forward portion of said lower wall, said plate member having side walls secured to said lower wall to be integral therewith and forming a chamber therebetween, an air inlet in connection with said plate member into said chamber, the forward end of said plate member being spaced from said tip portion of said upper wall forming a slot therebetween, said end portion overlying a portion of said slot a cleaning fluid line attached to said housing in communication with said chamber, a fluid outlet attached to the end of said line, said fluid outlet being positioned to direct a stream of cleaning fluid onto the area underlying said slot.

2. The structure of claim 1, wherein said upper wall terminating in a downwardly curved tip.

3. The structure of claim 1, wherein said upper wall terminates in a downwardly reversely curved tip portion extending to be substantially in vertical alignment with said end portion of said lower wall.

4. The structure of claim 1, wherein said plate member underlying said lower wall being substantially flat and forwardly transversely tapered.

5. The structure of claim 1, wherein said lower wall terminates in a free extending end portion.

6. The structure of claim 1, wherein the plane of said slot in operating position is disposed to coincide with the plane of the surface of the material to be cleaned.

7. The structure of claim 1, wherein said stream of cleaning fluid is directed to move forwardly of the material to move forwardly of the area of the material to be cleaned.

8. In connection with a cleaning machine for smooth and napped surface material, a nozzle structure comprising a housing member, said housing member having an upper and lower wall forming a vacuum chamber therebetween, said upper wall terminating in a tip portion, said lower wall terminating in a free end portion spaced from said tip portion, a shallow channel plate member underlying the forward portion of said lower wall and forming a cleaning chamber therebetween, means in connection with said plate member providing air flow therethrough, the forward end of said plate member being spaced from said tip of said upper wall forming a slot therebetween, said free end portion of said lower wall to partially overlie said slot, a cleaning fluid line attached to said housing having access to said chamber, a fluid outlet attached to said line extending into said cleaning chamber, and said fluid outlet being positioned to direct a stream of cleaning fluid to pass in a forwardly moving engagement with the material to be cleaned underlying said slot.

9. The structure of claim 8, wherein said tip portion of said upper wall being downwardly reversely curved to underlie said free end portion of said lower wall.

10. The structure of claim 8, wherein said free end portion of said lower wall being adjustable as to its spacing from the plane of said slot.

11. The structure of claim 8, wherein said cleaning chamber decreases in height as it extends forwardly.

12. The structure of claim 8, wherein said air flow and said cleaning fluid being comingled and extending the full width of said cleaning chamber upon engagement of material underlying said slot.

* * * * *